US010490931B2

(12) United States Patent
Furuya et al.

(10) Patent No.: US 10,490,931 B2
(45) Date of Patent: Nov. 26, 2019

(54) SEAL MEMBER AND ELECTRICAL CONNECTOR

(71) Applicant: Tyco Electronics Japan G.K., Kanagawa (JP)

(72) Inventors: Sumiyoshi Furuya, Kanagawa (JP); Shinji Amemiya, Kanagawa (JP); Fumito Nagashima, Kanagawa (JP)

(73) Assignee: Tyco Electronics Japan G.K., Kanagawa (JP)

( * ) Notice: Subject to any disclaimer, the term of this patent is extended or adjusted under 35 U.S.C. 154(b) by 0 days.

(21) Appl. No.: 15/944,090

(22) Filed: Apr. 3, 2018

(65) Prior Publication Data

US 2018/0287293 A1 Oct. 4, 2018

(30) Foreign Application Priority Data

Apr. 3, 2017 (JP) ..... 2017-73439
Mar. 2, 2018 (JP) ..... 2018-37052

(51) Int. Cl.
*H01R 13/52* (2006.01)
*H01B 5/12* (2006.01)
(Continued)

(52) U.S. Cl.
CPC ..... *H01R 13/5208* (2013.01); *H01R 13/5202* (2013.01); *H01B 5/12* (2013.01);
(Continued)

(58) Field of Classification Search
CPC ..... H01R 13/5208; H01R 13/5202; H01R 13/514; H01R 13/518; H01R 13/6593;
(Continued)

(56) References Cited

U.S. PATENT DOCUMENTS 4,030,797 A * 6/1977 Nieman ..... H01R 13/6315 439/248
4,349,241 A * 9/1982 Juris ..... H01R 13/6584 439/88

(Continued)

FOREIGN PATENT DOCUMENTS

JP 9-129304 A 5/1997
JP 2010-153072 A 7/2010

OTHER PUBLICATIONS

Extended European Search Report, European Patent Application No. 18165108.4, dated Aug. 6, 2018, 8 pages.

*Primary Examiner* — Abdullah A Riyami
*Assistant Examiner* — Vladimir Imas
(74) *Attorney, Agent, or Firm* — Barley Snyder

(57) ABSTRACT

A seal member for an electrical connector comprises a base portion, a wire seal portion disposed in the base portion, a housing seal portion disposed on an outer end portion of a radial outside of the base portion, and a shell seal portion integrally formed with the base portion, the wire seal portion, and the housing seal portion. The wire seal portion is configured to contact an outer peripheral portion of a wire led out from a housing of the electrical connector. The housing seal portion is configured to be pressed against the housing. The shell seal portion is configured to be pressed against at least a bottom portion of a shell enclosing the housing.

20 Claims, 4 Drawing Sheets

(51) Int. Cl.
*H01R 13/518* (2006.01)
*H01R 13/514* (2006.01)
*H01R 13/6593* (2011.01)
*H01R 13/6596* (2011.01)

(52) U.S. Cl.
CPC ..... *H01R 13/514* (2013.01); *H01R 13/518* (2013.01); *H01R 13/6593* (2013.01); *H01R 13/6596* (2013.01); *H01R 2201/26* (2013.01)

(58) Field of Classification Search
CPC ... H01R 13/6596; H01R 2201/26; H01B 5/12
USPC ..... 439/271
See application file for complete search history.

(56) References Cited

U.S. PATENT DOCUMENTS 4,421,373 A * 12/1983 Ratchford ..... H01R 13/5219 439/152
4,447,103 A * 5/1984 Werth ..... H01R 13/5219 439/152
4,521,064 A * 6/1985 Knapp ..... H01R 13/5219 439/153
5,057,030 A * 10/1991 Hutson ..... H01R 13/5202 439/247
5,092,794 A * 3/1992 Kachlic ..... H01R 13/6582 439/607.41
5,595,496 A * 1/1997 Konda ..... H01R 13/5219 439/271
5,618,206 A * 4/1997 Sawada ..... H01R 13/5208 439/274
5,720,629 A * 2/1998 Self, Jr. ..... H01R 13/5208 439/274
5,730,625 A * 3/1998 Sikora ..... H01R 13/4364 439/271
6,280,208 B1 * 8/2001 Masuda ..... H01R 4/64 174/359
6,475,008 B1 * 11/2002 Marolda ..... H01R 13/523 439/271
6,705,894 B1 * 3/2004 Comerci ..... H01R 13/506 439/607.47
6,752,659 B2 * 6/2004 Nakamura ..... H01R 13/5208 439/275
6,953,357 B2 * 10/2005 Fukushima ..... H01R 13/5219 439/271
7,083,471 B2 * 8/2006 Hayashi ..... H01R 13/5221 439/159
7,097,500 B2 * 8/2006 Montena ..... H01R 9/05 439/587
7,811,116 B2 * 10/2010 Sakakura ..... H01R 4/302 439/364
8,257,107 B2 * 9/2012 Tsuruta ..... H01R 13/6581 439/362
8,491,323 B2 * 7/2013 Ishibashi ..... H01R 13/5221 439/205
8,562,377 B2 * 10/2013 Kawamura ..... H01R 9/032 439/607.44
8,992,242 B2 * 3/2015 Casses ..... H01R 13/5219 439/271
9,312,626 B2 * 4/2016 Itsuki ..... H01R 13/5208
9,318,849 B2 * 4/2016 Kobayashi ..... H01R 13/5205
9,431,756 B2 8/2016 Kataoka et al.
9,472,901 B2 * 10/2016 Wang ..... H01R 13/648
9,570,831 B2 * 2/2017 Nakai ..... H01R 13/4226
9,570,839 B2 * 2/2017 Hashimoto ..... H01R 13/5202
9,722,340 B2 * 8/2017 Kato ..... H01R 13/6596
9,728,890 B2 * 8/2017 Nakai ..... H01R 13/52
9,755,384 B2 * 9/2017 Bury ..... H01R 9/26
9,825,398 B1 * 11/2017 Uchida ..... H01R 13/5219
10,062,974 B2 * 8/2018 Okamoto ..... H01R 4/30
10,074,924 B2 * 9/2018 Yamanaka ..... H01R 13/4367
10,084,260 B2 * 9/2018 Fabre ..... H01R 9/24
2003/0017728 A1 * 1/2003 Ogawa ..... H01R 13/748 439/79
2007/0184701 A1 * 8/2007 Yagome ..... H01R 13/506 439/271
2009/0130901 A1 * 5/2009 Aoki ..... H01R 13/652 439/587
2012/0312346 A1 * 12/2012 Roman, Jr. ..... H01R 13/5808 136/244
2013/0316573 A1 * 11/2013 Uno ..... H01R 11/12 439/573
2014/0004740 A1 * 1/2014 Uno ..... H01R 13/6592 439/607.58
2014/0120763 A1 * 5/2014 Itsuki ..... H01R 13/5825 439/382
2014/0120767 A1 5/2014 Itsuki et al.
2014/0287631 A1 * 9/2014 Tashiro ..... H01R 13/521 439/733.1
2016/0056590 A1 * 2/2016 Sugiyama ..... H01R 13/405 439/277
2016/0072211 A1 3/2016 Kato et al.
2017/0145272 A1 * 5/2017 Ooki ..... C09K 3/10

* cited by examiner

SEAL MEMBER AND ELECTRICAL CONNECTOR

CROSS-REFERENCE TO RELATED APPLICATIONS

This application claims the benefit of the filing date under 35 U.S.C. § 119(a)-(d) of Japanese Patent Application No. 2018-37052, filed on Mar. 2, 2018, and Japanese Patent Application No. 2017-73439, filed on Apr. 3, 2017.

FIELD OF THE INVENTION

The present invention relates to a seal member and, more particularly, to a seal member for an electrical connector.

BACKGROUND

A waterproof electrical connector disclosed in Japanese Patent Application No. 2010-153072A is a plug connector and has a wire seal positioned in a rear end portion of a housing of the plug connector. The wire seal contacts peripheries of a plurality of electrical wires inserted into the housing of the plug connector. The wire seal is integrally formed with a housing seal portion which contacts an inside of a housing of a mating connector.

In a shielded connector provided with a shell which is made of metal and which encloses the plug housing, the wire seal positioned in the rear end portion of the plug housing is pressed down by a seal cover. The seal cover is formed with a lock portion caught in the shell, and the shell encloses the seal cover and the plug housing. Furthermore, another seal, in addition to the wire seal, is positioned between the shell and the plug housing or the cap housing.

To prevent entry of water between the shell and the housing, it is necessary to position a seal extending from the wires to the position of the shell and press down the seal on the housing with the seal cover caught in the shell. Since an entire region of the seal through which the wires extend is pressed down with a portion of the seal cover, the lock portion is formed around a portion of the seal cover through which the wires extend.

The presence of the lock portion causes a distance from the position of the wires to the position of the shell to be far, and accordingly, the area of the seal extending from the position of the wires to the position of the shell is large, and the area of the seal cover for pressing down the seal is also large. Furthermore, the seal cover must have a size suitable for sufficiently pressing down and/or sufficiently locking the seal; the presence of the lock portion requires the seal cover to be thick frontward and rearward. There is a need in the art to reduce the size of an electrical connector with an electromagnetic shielding while maintaining waterproof performance.

SUMMARY

A seal member for an electrical connector comprises a base portion, a wire seal portion disposed in the base portion, a housing seal portion disposed on an outer end portion of a radial outside of the base portion, and a shell seal portion integrally formed with the base portion, the wire seal portion, and the housing seal portion. The wire seal portion is configured to contact an outer peripheral portion of a wire led out from a housing of the electrical connector. The housing seal portion is configured to be pressed against the housing. The shell seal portion is configured to be pressed against at least a bottom portion of a shell enclosing the housing.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
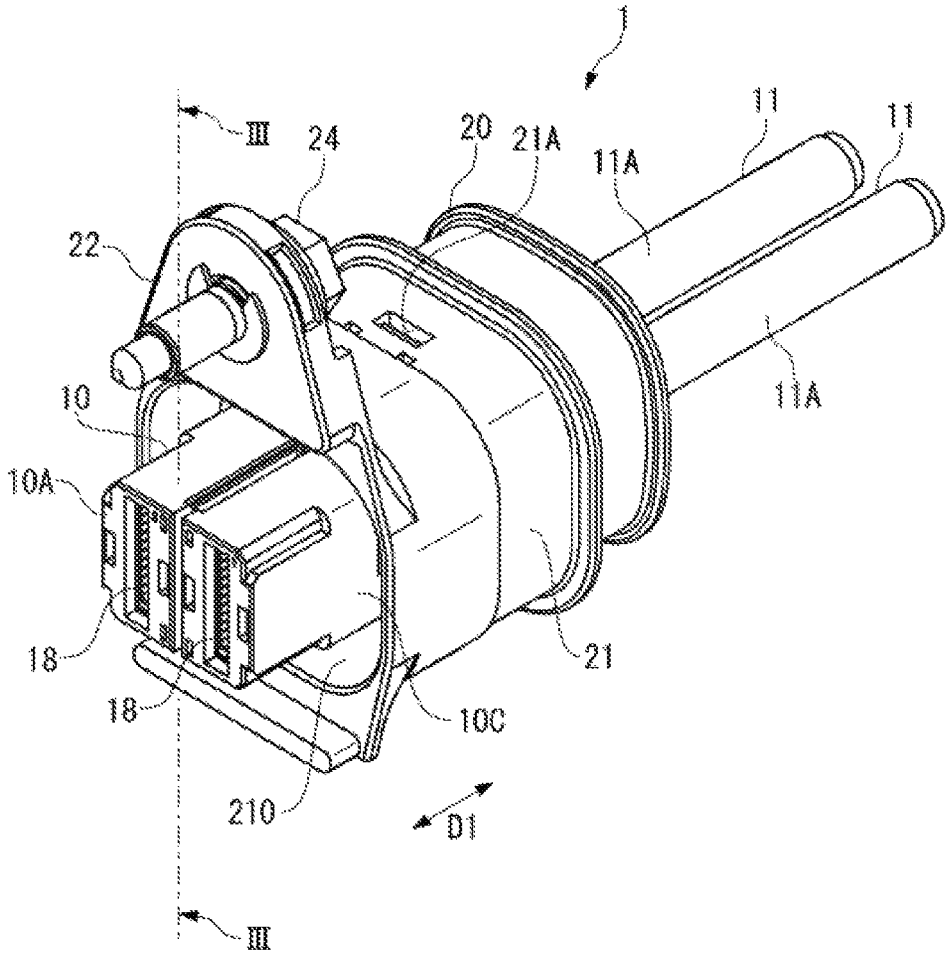
FIG. 1 is a front perspective view of an electrical connector according to an embodiment.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

Figure 2:
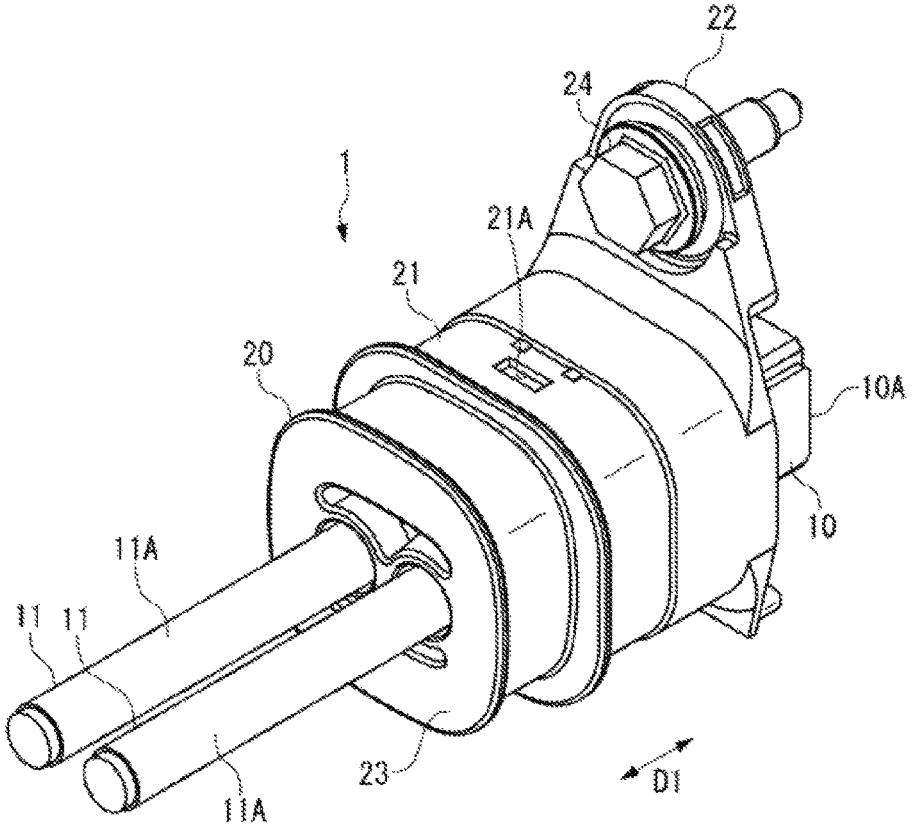
FIG. 2 is a rear perspective view of the electrical connector of FIG. 1.
Figure 3:
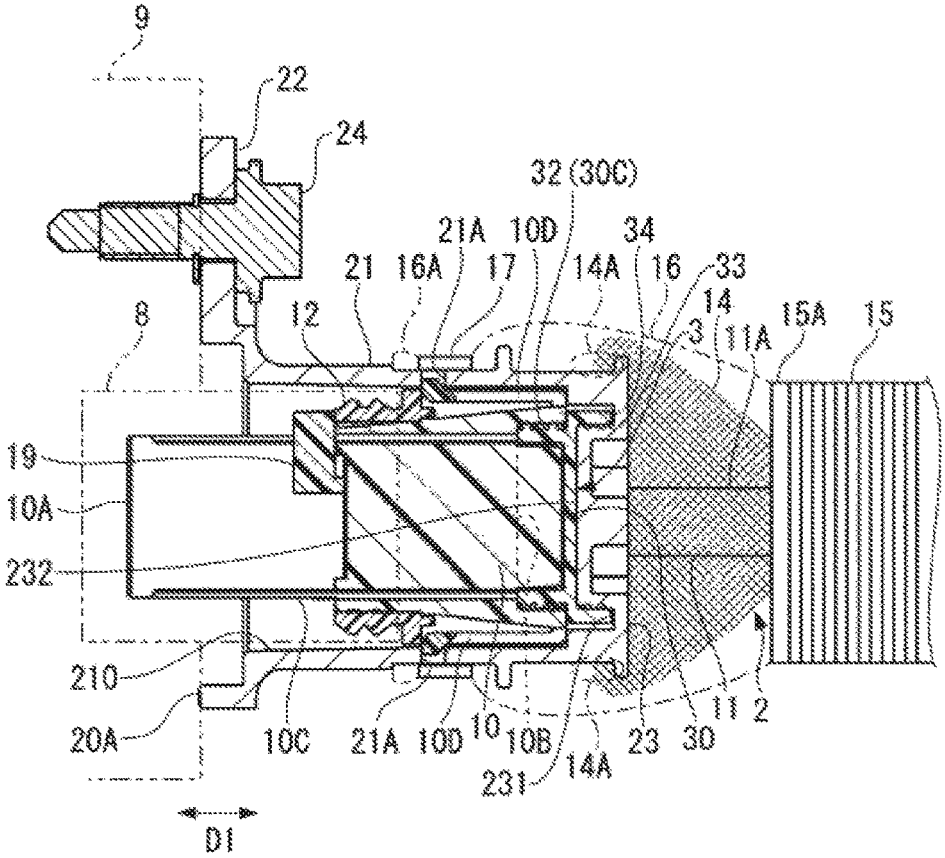
FIG. 3 is a sectional view of the electrical connector of FIG. 1, taken along line III-III.
Figure 4A:
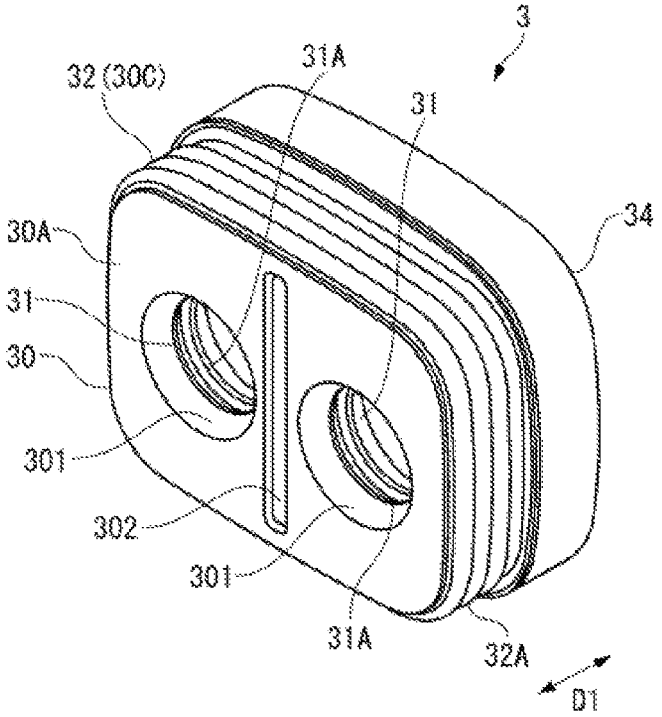
FIG. 4A is a front perspective view of a housing seal of the electrical connector.
Figure 4B:
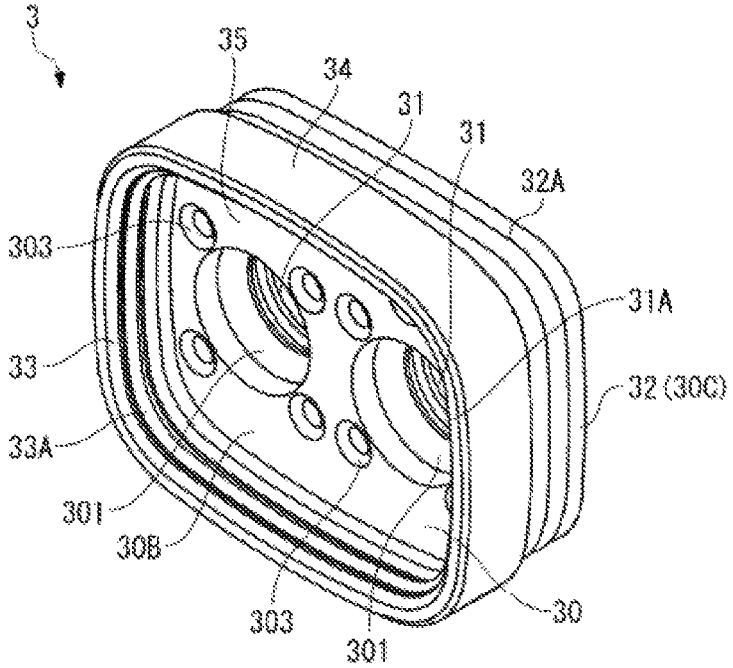
FIG. 4B is a rear perspective view of the housing seal.

An electrical connector 1 according to an embodiment is shown in FIGS. 1 and 2. The electrical connector 1 has a housing 10 from which two wires 11 are led out, a shell 20 for electromagnetic shielding, a seal member 3 positioned in the housing 10 as shown in FIGS. 3, 4A, and 4B, and a mating-portion seal 12 shown in FIG. 3. In the shown embodiment, the electrical connector 1 is a plug connector.

Throughout the description, a side from which the wires 11 are led out in the electrical connector 1 is defined as "rear", and the opposite side mated along a mating direction D1 shown in FIG. 1 to a mating connector is defined as "front". In an embodiment, the mating connector is assembled with a metal member 9 shown in FIG. 3, which is part of a case of a device. The mating connector has a mating housing 8 protruding out from the metal member 9.

In an embodiment, the electrical connector 1 and the mating connector are suitable for electrical connection of high voltage equipment, such as a PCU (Power Control Unit) installed on a vehicle. In order to reduce or eliminate the emission of electromagnetic noise outward from the equipment and/or the effect of electromagnetic noise from another piece of equipment, the electrical connector 1 and the mating connector have an electromagnetic shielding.

As shown in FIGS. 1-3, the wire 11 is a covered wire having a conductor core covered with an insulation layer. The wire 11 may be covered with a braided wire 14 for electromagnetic shielding as shown in FIG. 3. The braided wire 14 includes interlaced metal wires and, in some embodiments, a reinforcing material. The braided wire 14 is formed from a conductive metal material. Two wires 11 are positioned inside the braided wire 14. An end portion of the braided wire 14 is connected to an outer peripheral portion of the shell 20.

Two wires 11 and the braided wire 14 are bundled together containing a waterproof layer and/or member to form a bundle cable 2 shown in FIG. 3. The bundle cable 2 is disposed in a corrugated tube 15 made of resin. A distal end 15A of the corrugated tube 15 is connected with a grommet 16 formed from an elastic material, such as rubber and/or an elastomer, to the shell 20. A distal end 16A of the grommet 16 is retained on the outer peripheral portion of the shell 20 with a bundling member 17. The grommet 16 covers the wire 11 and the braided wire 14 extending from the distal end 15A of the corrugated tube 15.

The shell 20 is made of a metal material and, as shown in FIGS. 1-3, encloses the housing 10 and portions of the mating housing 8 of the mating connector. An end portion of the braided wire 14 is electrically connected to an outer peripheral wall of the shell 20. By grounding the shell 20 to the metal member 9, electromagnetic shielding is provided to the electrical connector 1 and the mating connector 8.

Each component of the electrical connector 1 will now be described in greater detail.

The housing 10, as shown in FIGS. 1 and 3, retains a female terminal 18 made of a metal material. The housing 10 is formed from an insulating resin material. In the shown embodiment, the electrical connector 1 is a two-position electrical connector 1 having two female terminals 18. In other embodiments, the electrical connector 1 may be a single position or three or more position connector. The female terminals 18 are connected with the respective wires 11.

A front end portion 10A of the housing 10 is positioned inside the metal member 9 as shown in FIG. 3. The wire 11 is led out rearward from a rear end portion of the housing 10 and penetrates the seal member 3.

The housing 10 has an accommodating portion 10B shown in FIG. 3 for accommodating a base portion 30 of the seal member 3. A bottom of the accommodating portion 10B has an opening through which the electrical wires 11 are led.

On an outer peripheral portion 10C of the housing 10, a mating-portion seal 12 formed in an annular shape is fitted as shown in FIG. 3. The mating-portion seal 12 is positioned in a stepped portion of the outer peripheral portion 10C, and a seal presser 19 prevents the mating-portion seal 12 from falling off frontward. When the housing 10 is received inside the mating housing 8, the mating-portion seal 12 elastically deforms radially between the outer peripheral portion 10C and an inner peripheral portion of the mating housing 8. The outer peripheral portion 10C has a lock beam 10D caught in the shell 20; part of the lock beam 10D is inserted into an engagement hole 21A of the shell 20.

The shell 20, as shown in FIGS. 1-3, entirely encloses the housing 10 except for the front end portion 10A of the housing 10. In an embodiment, the shell 20 is formed by die casting from a metal material, such as an aluminum alloy, a zinc alloy, or the like. The material of the shell 20 may be any material as long as it is a conductor, and any suitable metal material, whether magnetic or nonmagnetic, may be used for the shell 20.

The shell 20, as shown in FIGS. 1-3, has a side wall 21 enclosing the outer peripheral portion 10C of the housing 10, an attachment portion 22 extending to a front end of the side wall 21, and a shell bottom portion 23 extending to a rear end of the side wall 21. In an embodiment, the shell 20 is integrally formed in a single piece. The front end of the side wall 21 is opened, as shown in FIGS. 1 and 3, and the front end portion 10A of the housing 10 protrudes from an opening 210 of the side wall 21. The shell bottom portion 23 is located on the opposite side to the opening 210. The rear end of the side wall 21 is closed with the shell bottom portion 23.

The side wall 21 is formed in a cylindrical shape. The engagement hole 21A into which a part of the lock beam 10D is inserted is formed on both upper and lower sides of the side wall 21 as shown in FIG. 3. The mating housing 8 is inserted between the side wall 21 and the outer peripheral portion 10C of the housing 10.

The attachment portion 22 is fastened to the metal member 9 with a bolt 24 penetrating the attachment portion 22 as shown in FIG. 3. The contact with a predetermined contact pressure between a back surface of the attachment portion 22 and a surface of the metal member 9 fastened together ensures a required electrical connection between the shell 20 and the metal member 9 for electromagnetic shielding.

The shell bottom portion 23, as shown in FIGS. 2 and 3, presses down the seal member 3 positioned in the rear end portion of the housing 10 from behind. Since the shell bottom portion 23 is present, the electrical connector 1 does not require a seal cover for pressing down the seal member 3. The shell bottom portion 23 has a peripheral groove 231 for accommodating a part of the seal member 3. The peripheral groove 231 extends along the entire periphery in the vicinity of a radial outer end of the shell bottom portion 23. A plug portion 232 enclosed with the peripheral groove 231 is inserted into a recessed portion 35 of the seal member 3 shown in FIG. 4B. The wire 11 penetrates the plug portion 232.

In order to prevent entry of water, the electrical connector 1 has two seal members: the mating-portion seal 12 and the seal member 3. Each of the seals 3, 12 is formed from an elastic material, such as rubber and/or elastomer. The mating-portion seal 12 and the seal member 3 block entry of water into the inside of the housing 10 and the mating housing 8 in which the terminals are housed. In order to prevent corrosion of a connection location 14A of the braided wire 14 to the shell 20, the seal member 3 and the grommet 16 block water from reaching the connection location 14A of the braided wire 14. It is necessary to prevent entry of water both between the housing 10 and the mating housing 8 and between the housing 10 and the wire 11. The mating-portion seal 12 prevents entry of water between the housing 10 and the mating housing 8, and the seal member 3 prevents entry of water between the housing 10 and the wire 11. In order to block entry of water between the housing 10 and the wire 11, it is necessary to press the seal member 3 against the housing 10 around a region where the wire 11 is positioned as to bring the seal member 3 into close contact with the outer peripheral portion 11A of the wire 11.

The seal member 3, as shown in FIGS. 3, 4A, and 4B, prevents the entry of water at a plurality of locations. The seal member 3 is sandwiched between the rear end portion of the housing 10 and the shell bottom portion 23. The wires 11 led out rearward from the housing 10 and penetrate the seal member 3.

The seal member 3 has a base portion 30 interposed between the housing 10 and the shell bottom portion 23, the same number of wire seal portions 31 as the wires 11, a housing seal portion 32, a shell seal portion 33, and a peripheral wall 34 as shown in FIGS. 3, 4A, and 4B. The plurality of wire seal portions 31, the housing seal portion 32, the shell seal portion 33, and the peripheral wall 34 all extend to the base portion 30 and integrally connected via the base portion 30; the seal member 3 is integrally formed in a single piece.

When the housing 10 is inserted into the shell 20 with the seal member 3 accommodated inside the shell 20, the lock beam 10D of the housing 10 enters the engagement hole 21A of the shell 20, and gets caught in the side wall 21. Thereupon, the seal member 3 elastically deforms by being pressed between the housing 10 and the shell 20, and each of the seal portions 31, 32, 33 of the seal member 3 comes into close contact with a counter-contact member.

The base portion 30 is so positioned as to be perpendicular to the mating direction D1 between the bottom of the accommodating portion 10B of the housing 10 and the plug portion 232 of the shell bottom portion 23. The base portion 30 has a front portion 30A, shown in FIG. 4A, coming into contact with the bottom of the accommodating portion 10B, and a rear portion 30B, shown in FIG. 4B, coming into contact with the plug portion 232 of the shell bottom portion 23. The front portion 30A is pressed against a peripheral portion of the opening in the bottom of the accommodating portion 10B from which the wires 11 are led out.

The base portion 30 has seal holes 301 individually corresponding to the plurality of wires 11 as shown in FIGS. 4A and 4B. The seal holes 301 are formed along a mating direction D1 connecting the front portion 30A and the rear portion 30B. The wires 11 penetrate the respective seal holes 301. The wire seal portions 31 are disposed on inner peripheral portions of the seal holes 301. The plurality of wire seal portions 31 with which the base portion 30 is provided collectively prevent entry of water around the plurality of wires 11. Each wire seal portion 31 includes one or more ridges 31A extending along the circumference of the seal hole 301. The ridge 31A elastically deforms radially, thereby coming into close contact with the outer peripheral portion 11A of the wire 11.

The front portion 30A and the rear portion 30B, as shown in FIGS. 4A and 4B, are formed with depressions 302, 303 having shapes suitable for facilitating elastic deformation at suitable locations in order to allow the seal member 3 to elastically deform sufficiently to enhance close contact with the counter-contact members. The depressions 302, 303 include a groove 302 located between the two seal holes 301 in the front portion 30A and/or a plurality of recessed portions 303 formed in the rear portion 30B. Except for these depressions 302, 303 and the positions of the seal holes 301, the front portion 30A and the rear portion 30B are flatly formed.

The housing seal portion 32 is disposed on an outer end portion 30C located on a radial outside of the base portion 30, as shown in FIGS. 4A and 4B, and is pressed against the housing 10. The housing seal portion 32 includes one or more ridges 32A extending along the periphery. The ridge 32A is pressed radially against an inner wall of the accommodating portion 10B in which the base portion 30 is housed. The wire seal portion 31 and the housing seal portion 32, pressed against the housing 10 at a location radially outside a region where the two wires 11 penetrate, block water from entering the housing 10 from the peripheries of the wires 11 frontward and radially outward and further beyond an outer end of the housing 10.

The shell seal portion 33, as shown in FIG. 3, is pressed against the shell bottom portion 23 at a location radially inside the connection location 14A of the braided wire 14. The shell seal portion 33 includes a ridge 33A extending along the periphery. The ridge 33A is pressed radially with an outer peripheral portion of the plug portion 232 of the shell 20. As shown in FIG. 4B, the shell seal portion 33 is disposed on an inner peripheral portion of the peripheral wall 34 protruding rearward from the base portion 30.

The peripheral wall 34, as shown in FIGS. 3 and 4B, protrudes rearward from the vicinity of the outer end portion 30C of the base portion 30 and extends along the entire periphery; the peripheral wall 34 protrudes rearward from the base portion 30 radially outside the outer end portion 30C. When the plug portion 232 of the shell bottom portion 23 is inserted into the recessed portion 35 formed inside the peripheral wall 34, the peripheral wall 34 is accommodated in the peripheral groove 231 of the shell bottom portion 23.

An entire radial region of the base portion 30 is pressed with the plug portion 232 inserted into the peripheral wall 34, and consequently, the base portion 30 is sufficiently elastically deformed longitudinally in the mating direction D1. Thereby, the close contact of the wire seal portion 31 and the housing seal portion 32 with their respective counter-contact members is enhanced. Furthermore, a proximal end of the peripheral wall 34 located radially outside the outer end portion 30C of the base portion 30 comes into contact with the housing 10, so that the close contact between the shell seal portion 33 and the outer peripheral portion of the plug portion 232 can also be enhanced by sufficiently elastically deforming the peripheral wall 34 between the housing 10 and the shell bottom portion 23. The shell seal portion 33 pressed with the shell 20 prevents entry of water between the shell 20 and the housing 10 covered with the shell 20.

In the electrical connector 1, because the functions of preventing entry of water at locations around the wires 11, between the housing 10 and the wires 11, and between the shell 20 and the housing 10 are integrated into one seal member 3, the number of components is reduced. Therefore, the manufacturing cost of the electrical connector 1, including the component cost and assembly cost, can be reduced. Usage of a plurality of seal members requires structures supporting them individually, whereas in the present embodiment it is only necessary to support the seal member 3 between the housing 10 and the shell bottom portion 23, and the electrical connector 1 has a reduced size.

Furthermore, since the seal cover is not present, a lock portion for catching the seal cover in the shell 20 is not required. Without being affected by the position of the lock portion of the seal cover, the position of the shell seal portion 33 coming into contact with the shell 20 can be set in the vicinity of the wires 11 to a similar extent to the housing seal portion 32. This allows the seal member 3 to be positioned from the positions of the wires 11 to the position of the housing seal portion 32 and/or the shell seal portion 33, namely, in a smaller region minimally required for prevention of entry of water, so that the size of the seal member 3 can be reduced. Since a region not contributing to prevention of entry of water, such as the lock portion of the seal cover, is eliminated, the seal member 3 is not expanded accordingly, and therefore a surface pressure of the seal member 3 pressed between the shell 20 and the housing 10 can be more sufficiently secured as compared with the case that the electrical connector 1 is provided with a seal cover.

In other embodiments, the shell seal portion 33 of the seal member 3 may be formed on an outer peripheral portion of the peripheral wall 34. In that case, the shell seal portion 33 is pressed against an inner wall on an outer peripheral side of the peripheral groove 231 of the shell bottom portion 23. In addition, depending on the shapes of the shell 20 and the seal member 3, the shell seal member 33 may be pressed against both the side wall 21 and the shell bottom portion 23 of the shell 20. Further, unless an interference with the lock beam 10D occurs, it is also possible to protrude the peripheral wall 34 of the seal member 3 frontward from the base portion 30. The shell seal portion 33 can be formed on the inner peripheral portion or the outer peripheral portion of that peripheral wall 34.

What is claimed is:

1. A seal member for an electrical connector, comprising:

a base portion;

wire seal portion disposed in the base portion and configured to contact an outer peripheral portion of a wire led out from a housing of the electrical connector;

a housing seal portion disposed on an outer end portion of a radial outside of the base portion and configured to be pressed against the housing; and a shell seal portion integrally formed with the base portion, the wire seal portion, and the housing seal portion and configured to be pressed against at least a bottom portion of a shell enclosing the housing.

2. The seal member of claim 1, further comprising a peripheral wall protruding from the base portion.

3. The seal member of claim 2, wherein a region of the bottom portion of the shell is inserted into the peripheral wall.

4. The seal member of claim 3, wherein the shell seal portion is disposed on an inner peripheral portion of the peripheral wall.

5. The seal member of claim 4, wherein the peripheral wall protrudes radially outside the outer end portion of the base portion.

6. The seal member of claim 1, wherein the base portion has a seal hole extending through the base portion from a front portion of the base portion to a rear portion of the base portion.

7. The seal member of claim 6, wherein the wire seal portion is disposed on an inner peripheral portion of the seal hole and the wire extends through the seal hole.

8. The seal member of claim 6, wherein the shell seal portion, the base portion, the wire seal portion, and the housing seal portion are integrally formed from an elastic material.

9. The seal member of claim 8, wherein the front portion and/or the rear portion have a plurality of depressions configured to facilitate elastic deformation of the base portion.

10. An electrical connector, comprising:

a housing configured to be mated with a mating housing;

a shell made of a metal material and enclosing the housing; and a seal member configured to be penetrated by a wire led out from the housing, the seal member pressed between a bottom portion of the shell and the housing and including:

a base portion;

wire seal portion disposed in the base portion and configured to contact an outer peripheral portion of the wire;

a housing seal portion disposed on an outer end portion of a radial outside of the base portion and configured to be pressed against the housing; and a shell seal portion integrally formed with the base portion, the wire seal portion, and the housing seal portion and configured to be pressed against the bottom portion of the shell.

11. The electrical connector of claim 10, wherein the wire is covered with a braided wire and an end portion of the braided wire is connected to an outer peripheral portion of the shell.

12. The electrical connector of claim 10, wherein the housing retains a terminal connected to the wire.

13. The electrical connector of claim 10, wherein the housing has a front end portion, an accommodating portion receiving the base portion of the seal member, and an outer peripheral portion.

14. The electrical connector of claim 13, further comprising a mating-portion seal disposed on the outer peripheral portion of the housing, the mating-portion seal configured to be elastically deformed radially between the outer peripheral portion of the housing and the mating housing.

15. The electrical connector of claim 13, wherein the housing has a lock beam on the outer peripheral portion of the housing, the lock beam engaging the shell.

16. The electrical connector of claim 13, wherein the front end portion of the housing is positioned inside a metal member connected to the mating housing.

17. The electrical connector of claim 13, wherein the shell is integrally formed with a side wall enclosing the outer peripheral portion of the housing, an attachment portion extending at a front end of the side wall, and the bottom portion of the shell extending at a rear end of the side wall.

18. The electrical connector of claim 17, wherein the mating housing is inserted between the outer peripheral portion of the housing and the side wall of the shell.

19. The electrical connector of claim 10, wherein the seal member has a peripheral wall protruding from the base portion.

20. The electrical connector of claim 19, wherein the bottom portion of the shell has a peripheral groove receiving the peripheral wall of the seal member.

* * * * *